US005141780A

United States Patent [19]

Hackler et al.

[11] Patent Number: 5,141,780

[45] Date of Patent: Aug. 25, 1992

[54] MULTIFILAMENT YARN WITH ADHESIVE POLYMER COMPONENT

[75] Inventors: Lewis R. Hackler, Colonial Heights; Robert A. Lofquist, Richmond, both of Va.

[73] Assignee: Allied-Signal Inc., Morris Township, Morris County, N.J.

[21] Appl. No.: 636,860

[22] Filed: Jan. 2, 1991

[51] Int. Cl.[5] ..... B05D 3/02

[52] U.S. Cl. ..... 427/389.9; 427/208.2; 427/198; 57/351; 28/252; 28/281; 28/273

[58] Field of Search ..... 28/255, 103, 273, 281, 28/253, 252; 427/208.2, 198, 195, 189, 389.9; 57/255, 242, 351

[56] References Cited

U.S. PATENT DOCUMENTS

| | | | |
|---|---|---|---|
| 2,911,784 | 11/1959 | Vandervoort | 28/273 |
| 3,284,871 | 11/1966 | Yano et al. | 28/253 |
| 3,739,567 | 6/1973 | Williamson | 427/358 |
| 3,955,254 | 5/1976 | Delarue et al. | 28/255 |
| 4,080,347 | 3/1978 | Hefele | 156/321 |
| 4,120,078 | 10/1978 | Martin et al. | 28/255 |
| 4,555,430 | 11/1985 | Mays | 28/103 |
| 4,871,604 | 10/1989 | Hackler | 428/96 |

*Primary Examiner*—Shrive Beck
*Assistant Examiner*—Diana L. Dudash
*Attorney, Agent, or Firm*—William H. Thrower

[57] ABSTRACT

The invention is directed to a process for producing bulked synthetic multifilament yarn comprising a plurality of continuous synthetic filaments having deposited thereon at intermittent intervals an adhesive polymer component having a melting temperature below that of the continuous synthetic filaments. The process comprises texturizing synthetic multifilament yarn to obtain desired bulk characteristics by directing heated yarn in a current of heated fluid against a yarn plug contained in a texturizing chamber, applying said adhesive polymer component in a molten condition to the surface of said yarn plug, and continuously discharging texturized yarn from said texturizing chamber at a lower linear rate than the feed rate of said yarn to said texturizing zone while said adhesive polymer component is still in a molten but solidifying state, resulting in bulked synthetic multifilament yarn having the adhesive polymer component deposited thereon at intermittent intervals.

7 Claims, 1 Drawing Sheet

MULTIFILAMENT YARN WITH ADHESIVE POLYMER COMPONENT

FIELD OF THE INVENTION

The invention relates to synthetic multifilament yarn for carpet face fiber having deposited thereon intermittent amounts of a heat-activated adhesive polymer with a melting point substantially below that of the multifilament yarn, a process for texturizing the yarn which includes application of the heat-activated adhesive to the multifilament yarn, and the process for production of carpet comprising exposure of the textured multifilament yarn having deposited thereon the intermittent amounts of heat-activated adhesive to usual process conditions for twist setting the yarn which cause the heat-activated adhesive polymer to melt substantially completely and to flow to points of intersecting filaments of the yarn to create a bond upon subsequent cooling, thus altering aesthetic properties and performance of the resulting carpet product.

DESCRIPTION OF THE RELATED ART

It has been known to blend non-adhesive fibers with potentially adhesive fibers to form a yarn or other textile structure, then to activate the potentially adhesive fibers to bond them to contacting fibers, thus modifying end-use properties of the yarn. U.S. Pat. No. 2,252,999 to Wallach, issued Aug. 19, 1941, provides a process wherein a yarn comprising an admixture of non-adhesive and potentially adhesive fiber is formed, the potentially adhesive fiber is activated, and the fibers compacted while in an adhesive condition so that they adhere to each other at points of contact. U.S. Pat. No. 3,877,214 to Van der Werf, issued Apr. 15, 1975, discloses a twist-free yarn comprising a polyamide fiber melting under a relatively low temperature as a bonding component. U.S. Pat. No. 3,494,819 to McAllister, issued Feb. 10, 1970 discloses a blend of fusible and non-fusible polyethylene terephthalate fibers incorporated into fabric, wherein the finished fabric is heated to fusion temperatures to provide improved pill resistance. U.S. Pat. No. 3,978,267 to Selwood, issued Aug. 31, 1976 discloses a substantially twistless compact yarn comprising a proportion of potentially adhesive fiber which have been activated to bond to contacting fibers.

Cut pile carpet is customarily produced from staple yarn or bulked continuous filament yarn. Texturizing multifilament yarn by directing heated yarn in a current of heated fluid such as steam against a yarn plug contained in a texturizing zone is known in the art. For example, U.S. Pat. No. 3,409,956 to Longbottom et al. and U.S. Pat. No. 3,777,338 to Vermeer et al., hereby incorporated by reference. Bulked continuous filament nylon yarn is produced according to various conventional methods. The multifilament yarn is typically twisted and plied with similar yarn to form a 2-ply or 3-ply yarn construction which is twist set by utilizing one of several commercially available twist setting processes. In a typical process the yarn is then passed through a heated chamber while in a relaxed condition. The temperature of this process step is crucial to the proper twist setting of the base fiber, to obtain desired properties of the final carpet product. For nylon-6 base fiber, the conditions for this step are typically 195°-200° C. with a residence time of about 60 seconds for the Suessen process and about 135°-140° C. with a residence time of about 60 seconds for the Superba process.

Twisting, entangling, or direct cabling may be utilized in various processes. For example, a 2-ply twisted yarn combining 2 ends of 1185 denier 70 filament yarn is prepared and subjected to conventional twist setting conditions, such as those above or in an autoclave at 132° in saturated steam, with a residence time of about 60 seconds.

Multiple ends of the twist set yarns are tufted into a backing for cut pile carpet and conventionally finished to obtain the desired carpet product.

SUMMARY OF THE INVENTION

The invention is directed to a process for producing bulked synthetic multifilament yarn comprising a plurality of continuous synthetic filaments having deposited thereon at intermittent intervals an adhesive polymer component having a melting temperature below that of the continuous synthetic filaments. The process comprises texturizing synthetic multifilament yarn to obtain desired bulk characteristics by directing heated yarn in a current of heated fluid against a yarn plug contained in a texturizing chamber, applying said adhesive polymer component in a molten condition to the surface of said yarn plug, and continuously discharging texturized yarn from said texturizing chamber at a lower linear rate than the feed rate of said yarn to said texturizing zone while said adhesive polymer component is still in a molten but solidifying state, resulting in bulked synthetic multifilament yarn having the adhesive polymer component deposited thereon at intermittent intervals.

DESCRIPTION OF THE PREFERRED EMBODIMENT

Figure 1:
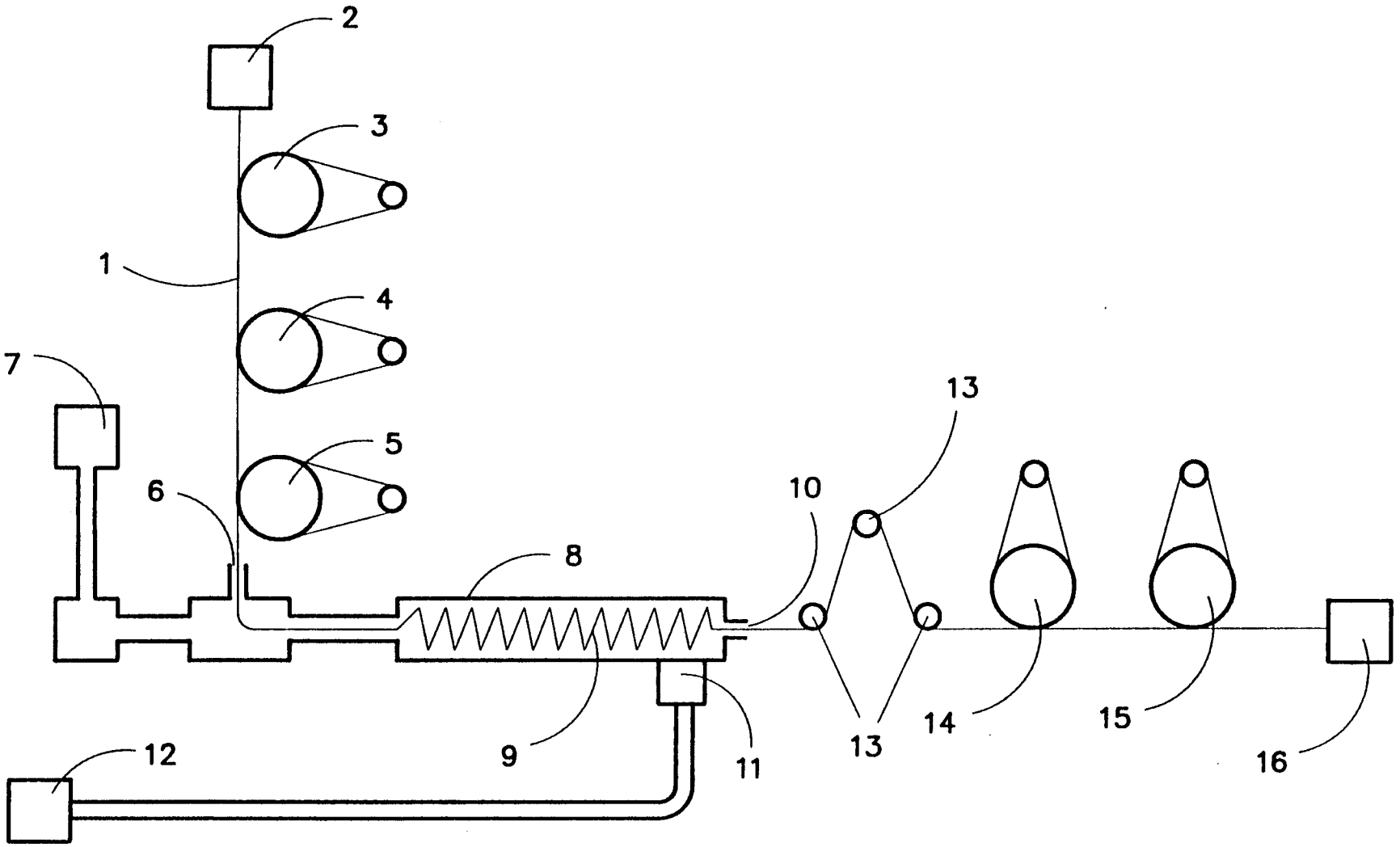
FIG. 1 provides a schematic representation of apparatus for accomplishing the application of intermittent amounts of a heat-activated adhesive polymer to texturized synthetic multifilament yarn.

With reference to FIG. 1, an undrawn multifilament yarn is withdrawn from creel 2, and subjected to desired drawing by draw rolls 3, 4 and 5. The drawn yarn is then textured on a steam-jet texturizer. The drawn yarn enters the texturizing apparatus at yarn inlet 6 where steam from source 7 heats the yarn, softening it to allow kinks and bends created in the crimping process to be inserted into the softened fiber, and carries the yarn through to the texturizing chamber 8, causing the yarn to be impinged against previously advanced yarn in the form of a yarn plug 9 which is maintained in the chamber due to the greater feed rate of the yarn to the chamber against the take-up rate. The texturizing chamber is many times larger than the yarn itself and allows the filaments to spread in all directions to form a dense yarn plug of compacted filaments which proceeds down the chamber until the now-textured yarn emerges. Details of the texturizing apparatus, not important to this invention, can be seen in U.S. Pat. No. 3,409,356 to Longbottom, incorporated herein by reference.

Just prior to the now-textured yarn emerging at outlet 10, a secreted bead of molten adhesive polymer component is smeared lightly through side port 11 which has been fitted onto the texturizing chamber. The molten adhesive polymer component is smeared onto the moving yarn plug at a desired rate. The adhesive polymer component is preferably applied at a level of 0.5 to 10 weight percent, more preferably 0.5 to 2 weight percent, based on weight of the synthetic multifilament yarn. The molten bead is supplied from apparatus 12 which controls the flow rate and melt temperature of the adhesive polymer component being applied to the polymer plug. Suitable equipment for hot melt application is commercially available from Mercer Corporation. The application of the secreted bead of adhesive polymer can be programmed to be applied continuously or intermittently to the yarn to achieve the desired level of application. Because not all filaments in the plug are exposed to the side-stream molten bead, the resulting textured yarn, when it is withdrawn from the chamber, has only intermittent smears of the adhesive polymer component applied. As the yarn proceeds through shake-out ladder 13 rolls 14 and 15, which serve to shake out or stretch out the crimp elongation, the adhesive polymer component solidifies, leaving the intermittent smears on the bulked texturized multifilament yarn. The resulting yarn is wound up, by winder 16, onto packages suitable for twisting.

Applicant has discovered that by incorporation of a minor proportion of heat-activated adhesive polymer component with substantially lower melting point than the base fiber into the yarn construction, the standard heat conditions for twist setting the yarn will cause the adhesive polymer component to melt. It will flow to intersecting points of base fiber and upon subsequent cooling will encapsulate and bind a number of fibers together, thereby improving the twist retention in cut-pile carpets. Carpets made with the yarn of this invention can be improved in surface aesthetics, apparent value, hand, durability, resilience and wear performance. By careful selection of the adhesive polymer component desired improvement is "built-in" to the yarn, with no additional process steps required by the yarn spinner, the carpet manufacturer, or in dyeing and finishing. Importantly, the use of a binder component such as the adhesive polymer component of this invention permits the reduction of plied yarn twist without loss of floor performance or surface appearance. Reducing twist provides substantial improvement in carpet apparent value.

The base fiber is selected from known synthetic fiber suitable for carpet use. Preferred base fiber includes polyamide, particularly nylon-6 and nylon-6,6, polypropylene and polyester, particularly polyethylene terephthalate.

The adhesive polymer component is selected to provide good adhesion to the base fiber. It is important that the melting point of the adhesive polymer component be in the range of 110°-170° C., preferably 130°-160° C., under ambient humidity conditions. This range ensures that the adhesive polymer component will melt during the conventional twist setting process yet will provide adequate adhesive properties during any subsequent dyeing steps and final use. A saturated steam environment, such as in an autoclave, reduces the fiber melting point dramatically.

A preferred class of adhesive polymer component for use with polyamide base fibers are copolyamides within the specified melting point ranges. Suitable copolyamides of the 6/66/12 type and a process for their production are disclosed in U.K. Patent 1,168,404, issued Oct. 22, 1969 to Inventa A. G., incorporated herein by reference.

By selection of the thermally activated adhesive polymer component within the weight ranges and melting point ranges specified it is possible to modify end-use properties of the finished carpet to improve wear resistance, resilience, reduced change of appearance over time and with use, and increased hand, lustre and apparent value. Denier per filament, cut length, fiber cross-section, crimp type and frequency, surface finish, melt viscosity, softening point, melting point, dye affinity, and other properties are crucial to achieving ideal properties in the final product. A proper selection of the adhesive polymer component must be made to obtain the desired or optimum results from the finished carpet product. This will depend on numerous factors including the denier, length, crimp, finish, and other properties of the base fiber product.

With the utilization of this invention, twist setting conditions normally used are sufficient to activate the adhesive polymer component to create bind points which strengthen the final product, thereby imparting other characteristics which are desirable. For the Suessen process, under relatively low humidity condition, the twisted yarn is subjected to a temperature of 190°-205° C. for a residence time of 50-60 seconds. In the Suessen process motion of the fiber while in the relaxed state, caused by vibration of air currents, sufficiently motivates the molten adhesive polymer component to flow to the intersecting "touch points" of the base fiber, as a function of the melt flow properties of the adhesive polymer component and surface characteristics. As the fiber emerges from the elevated temperature condition, the melt solidifies and encapsulates or bonds two or more base fibers together at intersecting points in a durable bond.

Subsequent processing including dyeing, finishing, and backcoating using commercial processing methods does not soften the bond points sufficiently to permanently weaken them, but rather will strengthen them. The resultant carpet can be of many forms, but a typical style would be cut-pile carpet with about 40 ounces per square yard of face yarn including the binder, with an attached backing. Carpet construction would be typically ⅛" gauge, ¾" pile height, and the carpet would be dyed, dryed, backcoated, and sheared using normal processing techniques. The yarn of the invention would also provide important property improvements in the production of loop-pile carpet.

What is claimed is:

1. A process for producing bulked synthetic multifilament yarn comprising a plurality of continuous synthetic filaments having deposited thereon at intermittent intervals an adhesive polymer component having a melting temperature below that of the continuous synthetic filaments, said process comprising:

texturizing synthetic multifilament yarn to obtain desired bulk characteristics by directing heated yarn in a current of heated fluid against a yarn plug contained in a texturizing chamber, applying said adhesive polymer component in a molten condition and in an amount of 0.5 to 10 weight percent, based on weight of the synthetic multifilament yarn, to the surface of said yarn plug, and continuously discharging texturized yarn from said texturizing chamber at a lower linear rate than the feed rate of said yarn to said texturizing zone while said adhesive polymer component is still in a molten state, resulting in said bulked synthetic multifilament yarn having the adhesive polymer component deposited thereon at intermittent intervals.

2. The process of claim 1 wherein said synthetic multifilament yarn is selected from the group consisting of polyamide, polyester and polypropylene.

3. The process of claim 2 wherein said synthetic multifilament yarn is polyamide and said adhesive polymer component is a copolyamide with a melting point within the range of 110° to 170° C. under ambient humidity conditions.

4. The process of claim 3 wherein said adhesive polymer component is a 06/66/12 copolyamide.

5. The process of claim 3 wherein said adhesive polymer component is applied in an amount of 0.5 to 2 weight percent.

6. The process of claim 5 wherein said adhesive copolymer component has a melting point within the range of 130° to 160° C.

7. The process of claim 6 wherein said adhesive polymer component is a 06/66/12 copolyamide.

* * * * *